United States Patent [19]

Ukai et al.

[11] 4,287,821

[45] Sep. 8, 1981

[54] ASEPTIC STORAGE TANK

[75] Inventors: Nobuo Ukai, Machida; Akira Funado, Funabashi; Tethuya Yokota, Mathudo, all of Japan

[73] Assignee: Kagome, Ltd., Japan

[21] Appl. No.: 80,059

[22] Filed: Sep. 28, 1979

[30] Foreign Application Priority Data

Sep. 28, 1978 [JP] Japan ..... 53-118623
Sep. 28, 1978 [JP] Japan ..... 53-118627

[51] Int. Cl.[3] ..... A23P 1/00

[52] U.S. Cl. ..... 99/646 C; 137/592; 141/100; 141/286; 220/81 R; 422/28; 422/41

[58] Field of Search ..... 422/28, 41, 40, 225, 422/242, 292, 243; 141/100, 286, 370; 137/592; 414/293, 299, 301; 220/81 R; 406/163; 99/646 S, 646 C

[56] References Cited

U.S. PATENT DOCUMENTS

| | | | |
|---|---|---|---|
| 1,297,760 | 3/1919 | Walters | 137/592 X |
| 1,440,109 | 12/1922 | Schenck | 422/242 X |
| 2,611,685 | 9/1952 | Yoder | 414/293 X |
| 2,791,355 | 5/1957 | Morgan, Jr. | 141/286 X |
| 3,064,833 | 11/1962 | Von Ruden | 414/301 |
| 3,457,047 | 7/1969 | Tokimatsu et al. | 422/225 X |
| 3,868,028 | 2/1975 | Mausser | 414/299 |
| 3,945,511 | 3/1976 | Delorme | 414/293 |
| 3,998,589 | 12/1976 | Rechtsteiner et al. | 422/41 X |

*Primary Examiner*—Arnold Turk
*Attorney, Agent, or Firm*—Robert E. Burns; Emmanuel J. Lobato; Bruce L. Adams

[57] ABSTRACT

A storage tank for storing of liquid food products partially processed before final processing. The tank is constructed with smooth germ-free internal surfaces to avoid recesses in which the stored food product or disinfecting fluids can be entrained and contaminate the tank and food product therein. A dispersion device in a conical top of the storage tank homogenizes the food product to be stored when introduced in the tank. The same dispersion device disperses treatment liquids introduced into the tank to effect dispersion onto all the inner surfaces for treatment thereof.

7 Claims, 13 Drawing Figures

ASEPTIC STORAGE TANK

BACKGROUND OF THE INVENTION

This invention relates generally to a storage tank for half-raw semi-raw food material, that is, the food material that has undergone only preliminary processing treatment and needs to be processed further into an ultimate food or drink at some later time. It relates more particularly to a storage tank provided with a new and novel dispersion device.

In processing farming products into food and drinks, the seasonal nature of their supply prevents them from being processed at one time into the form of an ultimate or final food and/or drinks. Hence these products are usually stored in a partially processed state and occasionally are taken out from their storing place in required amounts for processing further into a food or a drink. For instance, when preparing a tomato ketchup or sauce starting from fresh tomatoes, the tomatoes are preliminarily or partially processed and stored in the form of a semi-raw material, such as a puree or pastes. The material thus stored in a semi-raw state can then be taken from their storing place in required amounts for final processing into a tomato ketchup or sauce. For such a series of processing steps, it is absolutely necessary that such semi-raw material should be stored under a completely germ-free condition. Today, a large-size tank is preferentially used for storage of such semi-raw material.

However, such a tank should be completely immune or free from any pollution such as that emanating from the tank itself and various tank accessories or from intrusion from outside of microorganisms during storage of the partially-processed material. The various methods and apparatus for germ-free storage of the half-raw food material proposed in the past are such as those disclosed in the U.S. Pat. Nos. 3,871,824; 3,918,678; 3,918,942; 3,951,184 and 3,998,589. These prior art methods and apparatus do not relate to the specific shape or structure of the storage tank contemplated from the viewpoint of effectively combatting against bacterialogical pollution of the stored material.

In a storage tank proposed in the prior art, a manhole device is provided horizontally at the top of the tank to permit access to the inside of the tank. The lid plate of the manhole is provided with delivery and discharge openings for a detergent or disinfectant solutions or a disinfected inert gas, as well as a peephole device for monitoring the inside of the tank. Because of the necessity for connecting these accessory devices to the manhole lid plate, protuberant portions were unavoidably formed in the connecting portions. These proturberant portions would turn out to be a "sink" for the semi-raw material and detract from germ-free maintenance of the storage tank.

Moreover, when the semi-raw food material is stored within a tank with a capacity of from 100 to 200 m.$^3$ for a prolonged time, the food material would have a concentration gradient, that is, the concentration of the material would differ from one point within the tank to the other. Since the semi-raw material is taken out from the tank in required amounts, it is necessary that the material be contained homogeneously in the tank. In the prior art storage tanks, no effective means are provided for keeping the homogeneity of the stored material.

SUMMARY OF THE INVENTION

In order to eliminate the problems encountered in the prior art devices, the present invention contemplates provision of a storage tank having an optimum shape and structure for germ-free storage of semi-raw or partially-processed food materials. According to the present invention, the upper portion of the tank has interiorly therein a smooth conical shape and surfaces with one or more inlet openings at the apex portion. A manhole device and a peephole or inspection plate device are provided horizontally in the upper portion at different heights from the bottom of the tank. These devices are mounted flush with the inside surface of the upper portion for eliminating the formation of any "sink portions." A dispersion device is also mounted at the apex portion of the tank for assuring optimum dispersion of the material into the tank, disinfection and deterging of the inside of the tank and complete homogeneity of the semi-raw material contained therein.

It is to be noted that only a minor degree of pollution caused by bacteria or microorganisms may lead to serious detraction from the quality of the stored material as a whole. It is, therefore, a great advantage of the present invention that the inner walls or surfaces of the tank be completely free from protuberances that may serve as "sinks" and that the semi-raw food material be homogeneously distributed and dispersed throughout the inside of the storage tank due to the provision of a dispersion device.

BRIEF DESCRIPTION OF THE DRAWINGS

Other features and advantages of the storage tank will be understood from the appended claims and attached drawings in which:

DESCRIPTION OF THE PREFERRED EMBODIMENTS

Figure 1:
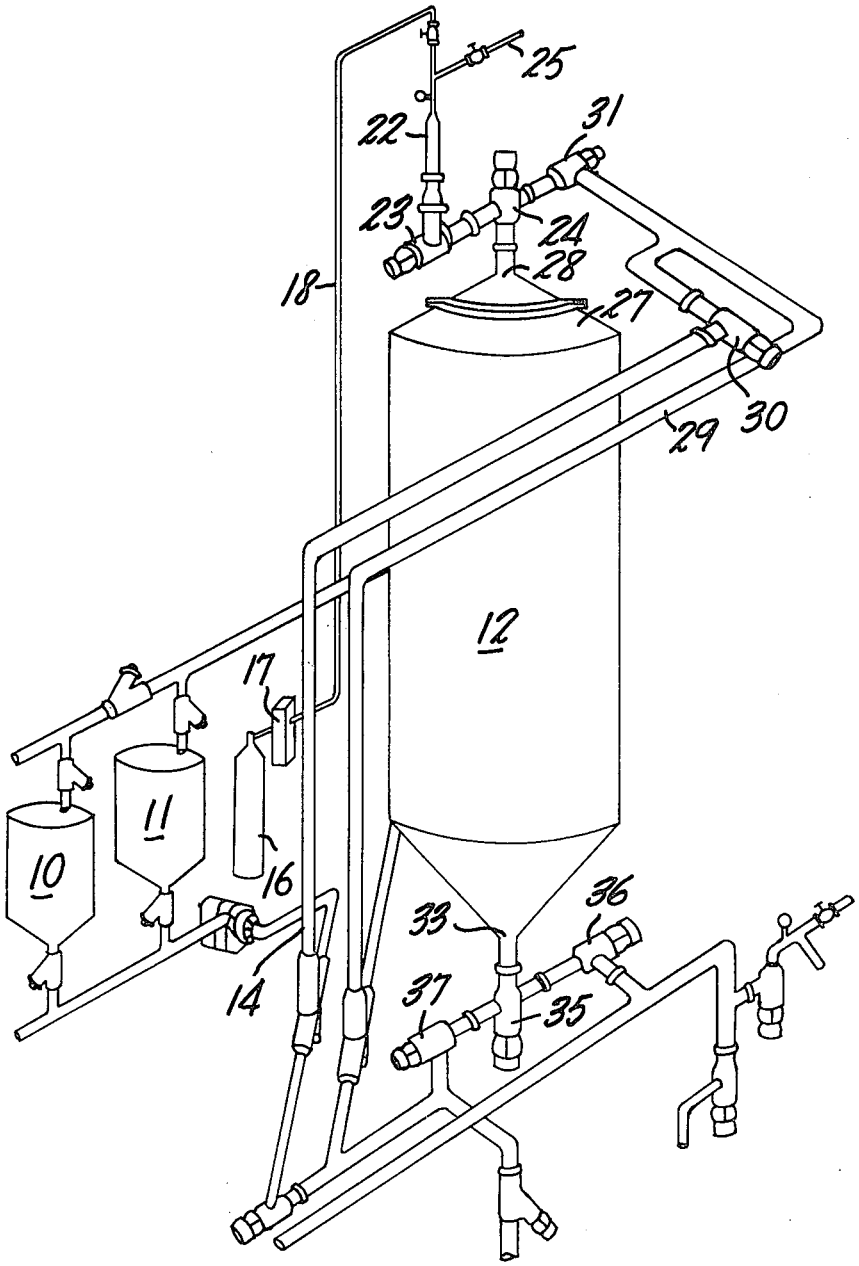
FIG. 1 is a schematic perspective view of the inventive storage tank with accessory devices according to the invention.

Referring to FIG. 1 an apparatus for germ-free storage of a partially-processed or semi-raw food material or product comprises a pair of vessels 10, 11 for storage of a disinfectant and a detergent solution. A storage tank 12 is connected to the two vessels through a line 14. The system includes a gas container 16 containing a disinfected inert gas. A pressure regulator 17 controls a constant pressure at which the gas is supplied to the top of the storage tank 12 through a gas supply line 18 and a bacterial filter 22 and through a plurality of aseptic valves 23, 24. The gas supply line 18 has connected thereto a steam line connection 25.

The upper part 27 of the storage tank 12 is conical in configuration and is provided at the apex thereof with an inlet connection 28 to the system. Partially processed food products are supplied through a line 29. The lines 14,29 are provided with aseptic valves 30,31. The bottom 33 of the storage tank 12 has an outlet connected by pipes to aseptic valves 35,36,37 for removal of the stored partially-processed food product for final processing.

Figure 2:
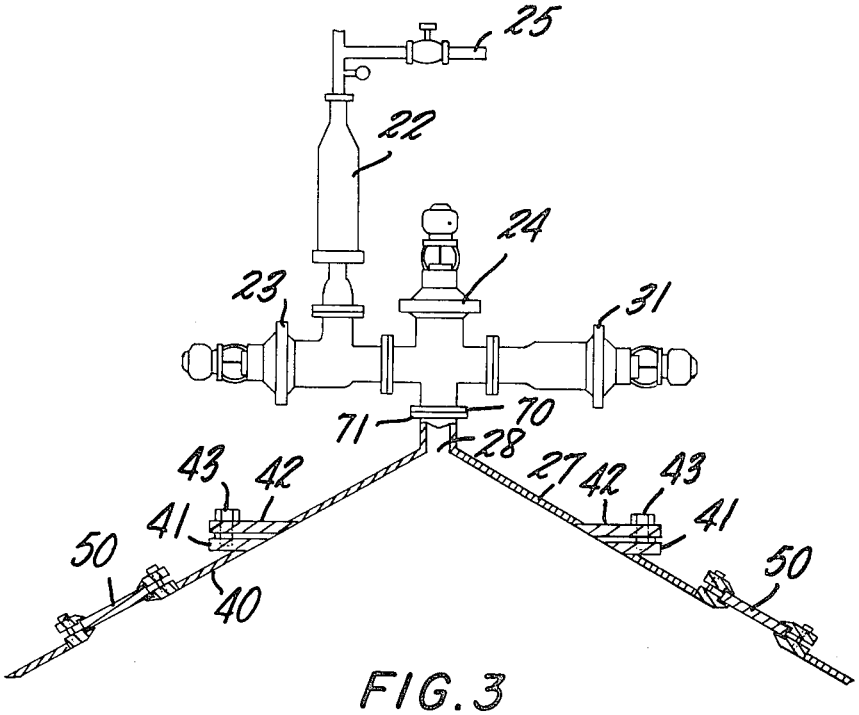
FIG. 2 is a fragmentary side view of the upper and apex portions of the storage tank of FIG. 1, partially shown in section and with a dispersion device of the invention omitted.

The conical upper part 27 of the storage tank 12 is provided with a manhole plate 40 provided with a flange 41 connectable to a flange 42 on the tank by bolts 43. The manhole plate and connecting flanges are constructed to receive a packing 45 therebetween and provide a structure which is smooth and flush with the smooth inner surfaces of the upper part of the tank as shown in FIG. 2. This prevents any pockets or recesses that can hold or retain any of the food contents of the tank and thus the formation of the "sinks" referred to above is avoided. The smooth inner surfaces 46,47, 48 of the tank flanges and packing avoid or eliminate the possibility of trapping food particles that can cause contamination.

Figure 5:
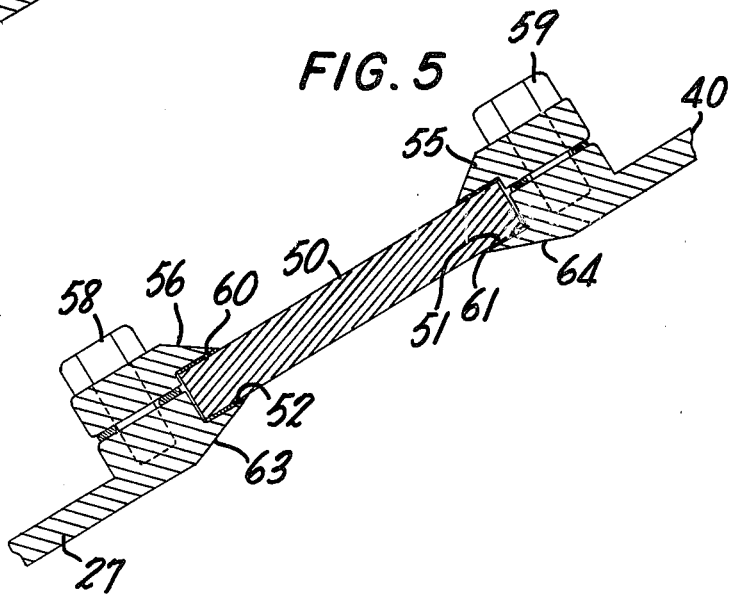
FIG. 5 is a sectional view of a peephole or inspection plate device mounted on the storage tank.

An inspection plate or peephole 50 is provided. It is made of a material, for example glass, for viewing the interior of the storage tank. It will be noted that the manhole and inspection plate may extend circumferentially of the upper part of the tank 12. The peephole plate 50 is shown on an enlarged scale in FIG. 5 and is mounted clamped between shoulders 51,52 on the manhole plate and the tank and rings 55,56 bolted by bolts 58,59 onto the tank and the manhole plate 40. Seals or packings 60,61 seal the gas plate 50 on upper and lower marginal surfaces thereof and provide a fluid-tight seal with the shoulders 51,52 and the clamping rings 55,56. The shoulders 51,52 have tapered inner surfaces 63,64 on the underside so that there is no entrapment of food particles by the inner surfaces of the peephole arrangement or structure and the tank can be kept germ-free.

Figure 3:
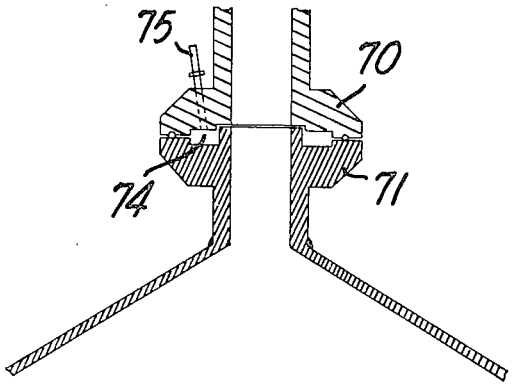
FIG. 3 is an enlarged sectional view of the apex portion of the storage tank with a dispersion device omitted.
Figure 4:
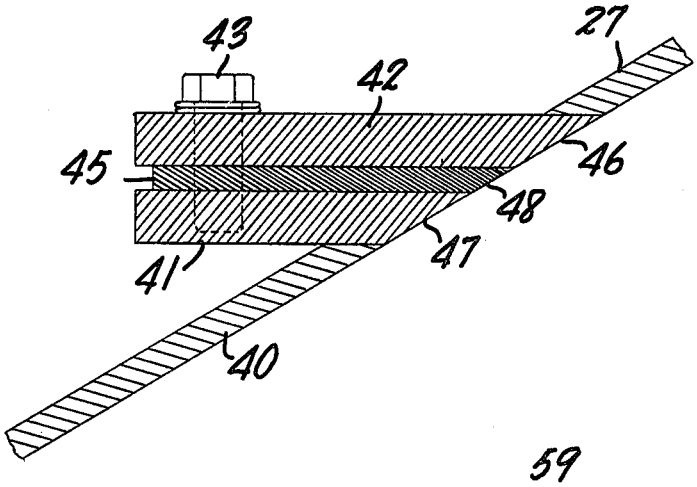
FIG. 4 is a sectional view of the manhole device mounted on the storage tank.

Provision is made for connecting the tank conical top or upper part with the system in a germ-free or aseptic connection as shown in FIG. 3. Thus the aseptic valve 24 is provided with a flange 70 and the tank top inlet has a flange 71 defining an annular space 74 therebetween to which a disinfectant solution is fed through a tube 75. The construction of the two flanges 70,71 illustrates the manner in which flanges throughout the system can be constructed to provide for a disinfectant providing a germ-free seal or connection at the mating surfaces of the flanges. For example, the connections of the various aseptic valves 23,24, 31 and the filter 22 can all be constructed as flange connections of the type illustrated in FIG. 3 providing germ-free structure for such connections.

Figure 6:
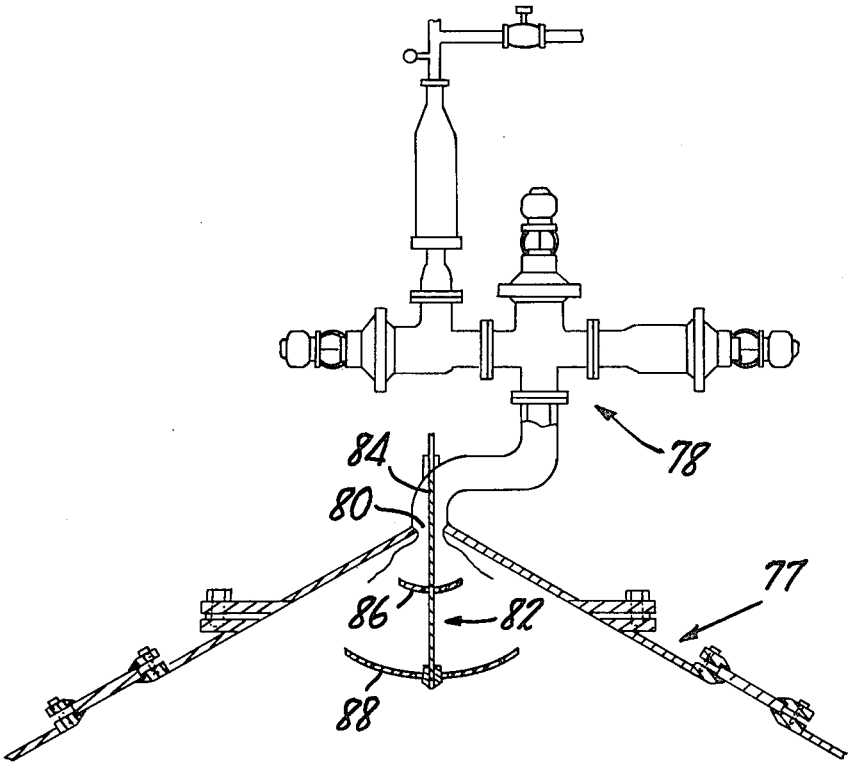
FIG. 6 is a side view of the upper and apex portions of the storage tank partly shown in section and with a dispersion device according to the invention, mounted in position.

Provision is made according to the invention for dispersing the inflow of food product into the storage tank in order to arrive at a homogeneous stored product. As illustrated in FIG. 6 a storage tank 77 constructed as before described is connected to a system 78, shown fragmentarily, as before described is provided with an inlet 80 for supplying a semi-processed food product into the storage tank for temporary storage therein. A dispersion device 82 is housed within the conical top of the storage tank 77. It comprises a suspension or support rod 84 supporting in fixed position, below the inlet 80 and in alignment therewith, a smaller dispersion disc 86 and a larger dispersion disc 88. The two discs are disposed coaxially and are dished or concave upwardly toward the inlet 80.

Figure 7:
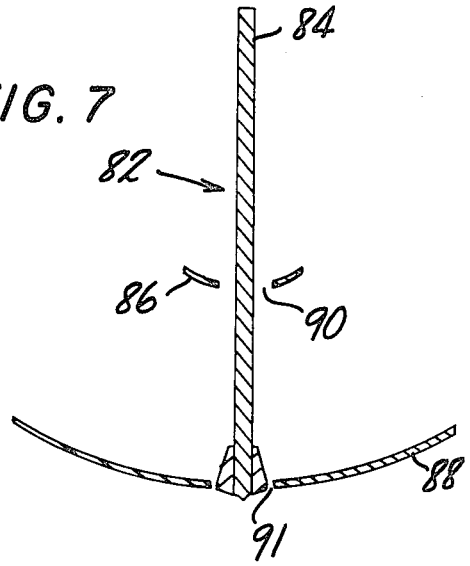
FIGS. 7 to 10 are enlarged schematic views of several embodiments of dispersion devices, according to the invention.

The dispersion device 82 is illustrated on an enlarged scale in FIG. 7. The two dished discs 86,88, provided with center openings 90,91 are attached through circumferentially spaced supports (not shown) extending radially from the support rod 84. The central opening 90 of the upper disc 86 is greater in diameter than the central opening 91 of the lower to facilitate delivery of material or fluid solutions from the upper disc to the lower disc.

The discs of the dispersion device are concave relative to the apex of the tank and convex relative to the bottom of the tank. The inflow of semi-processed food product is delivered onto the dispersion device and is homogenized. When the tank is free of a stored food product and is being treated with a liquid detergent or a disinfecting solution the inflowing liquid is splashed upwardly to the top of the tank and outwardly by the dispersion device. The liquid or solution is thus splashed onto the inner surfaces of the conical tank top and it runs down the inner sidewalls of the storage tank 12 under the control of gravity to clean and disinfect the tank. The convex lower surfaces effectively deliver the solutions toward the bottom of the tank.

Figure 8:
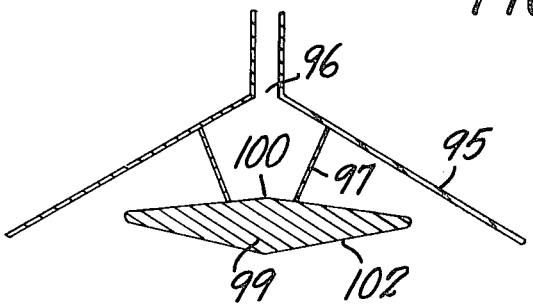

Another example of a dispersion device is illustrated in FIG. 8 wherein a storage tank 95 is shown fragementarily and wherein the top is conical and is provided with an inlet 96. Brackets 97 mount, below the inlet 96 in fixed position, a dispersion plate or disc 99 which has an upper surface 100 which is convex relative to the top and a lower surface 102 which is convex relative the storage tank bottom. The dispersion disc 99 functions to homogenize the food product delivered into the tank and to splash the cleaning and disinfecting liquids to the side surfaces as before described.

Figure 9:
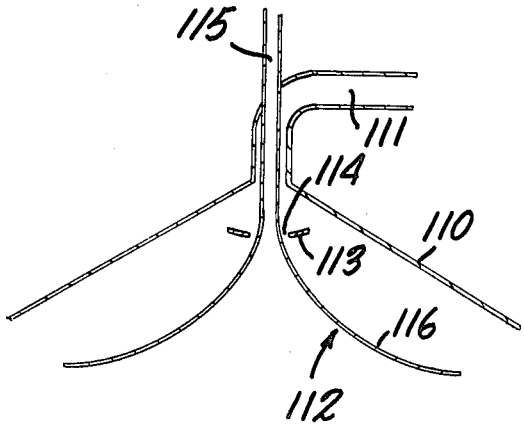

The two dispersion devices above described relate to storage tanks where a single inlet is provided on the storage tank. Provision is made for dual inlets in storage tanks made according to the invention. In FIG. 9 a tank 110 is illustrated fragmentarily. Only a portion of the top is shown and has an inlet conduit 111 defining an inlet circumferentially of a funnel-shaped dispersion device 112 having an upwardly dished disc 113 fixed thereto and having a central opening 114. The dispersion device has a conduit inlet 115 that can be used as another inlet. The outwardly flared part 116 of the dispersion device functions similarly to a lower concave disc of the dispersion devices heretofore described. It will be understood that the curvature is such that neither the liquid food product or other liquids are retained in the curved or flared part 116.

Figure 10:
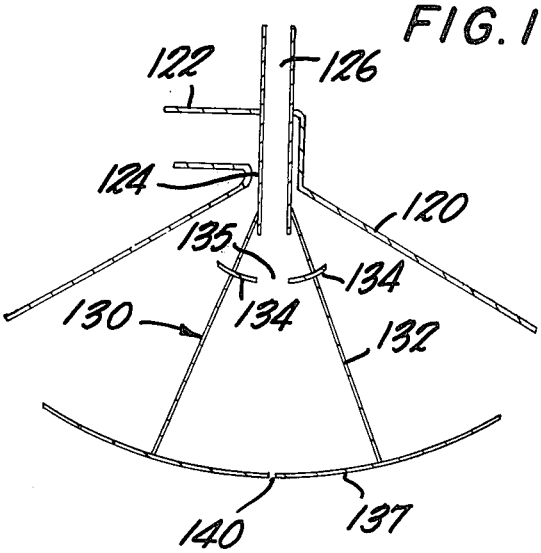

Another embodiment of a dual inlet tank is illustrated in FIG. 10 wherein a storage tank 120 is illustrated fragmentarily and has a conical top to which is connected, at the apex thereof, a conduit 122 defining an annular inlet 124 circumferentially of a conduit 126 coaxial therewith. The latter conduit functions as another inlet. A dispersion device 130 functions with flows through either inlet. It comprises a conical support arrangement 132 fixed to the conduit 126 and on which is mounted an upwardly dished disc 134 having a central opening 135. A lower larger diameter disc 137 on the dispersion device has a smaller central opening 140. The two discs function for dispersion in cooperation with inflows through both inlets.

Figure 11:
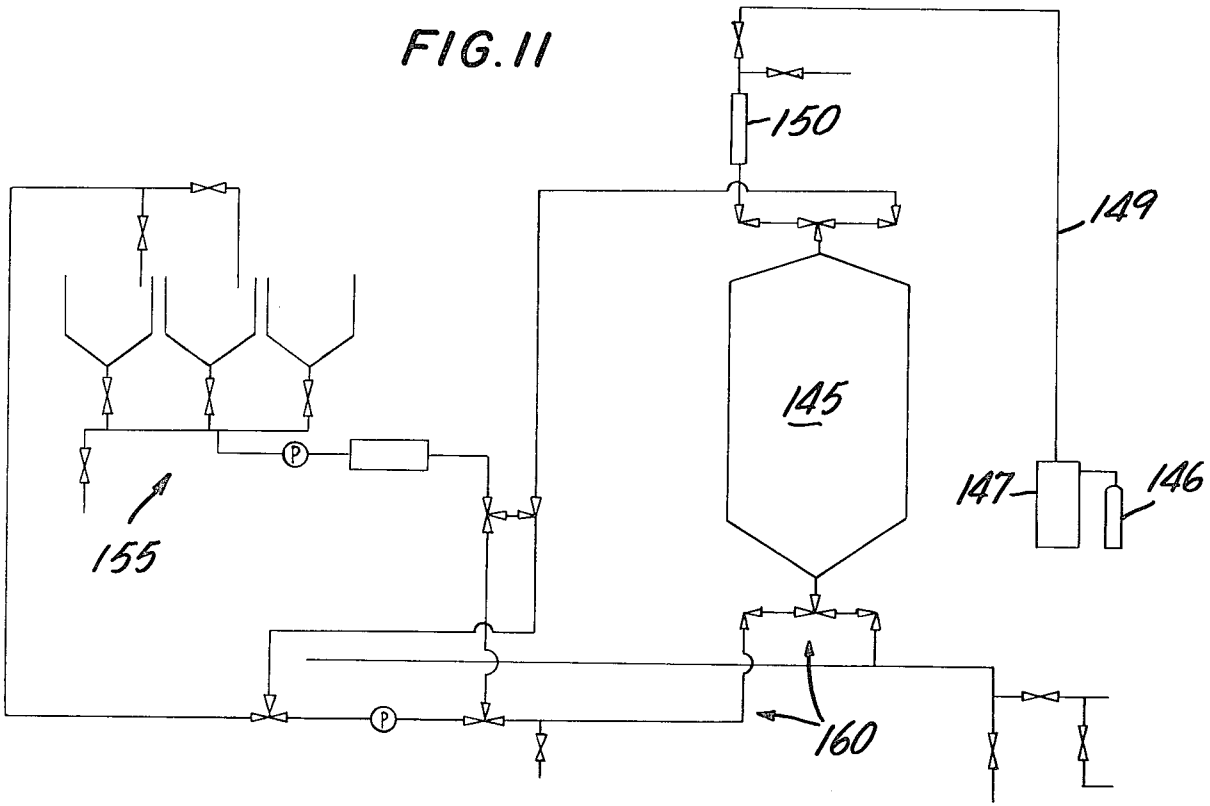
FIG. 11 is a schematic diagram of an overall storage apparatus used for disinfecting and deterging the storage tank.

A diagrammatic illustration of a system embodying the invention is disclosed in FIG. 11 wherein is illustrated a food storage tank provided with a constant internal pressure with an inert aseptic gas from a pressure vessel 146 through a pressure control system 147 along a pressure line 149 and a bacterial filter 150. The system includes a supply pipe arrangement 155 for supplying the food product to the tank from a container. Two other containers are provided to supply a liquid detergent and a disenfectant liquid through the top of the tank.

Provision is made for removal of the detergent and disinfectant liquid through a pipe arrangement 160 at the bottom of the storage tank 145. The preliminary-processed stored food product is taken out from the bottom through the lower piping arrangement shown. The tank in this instance has a single inlet at the apex of its conical top.

Figure 12:
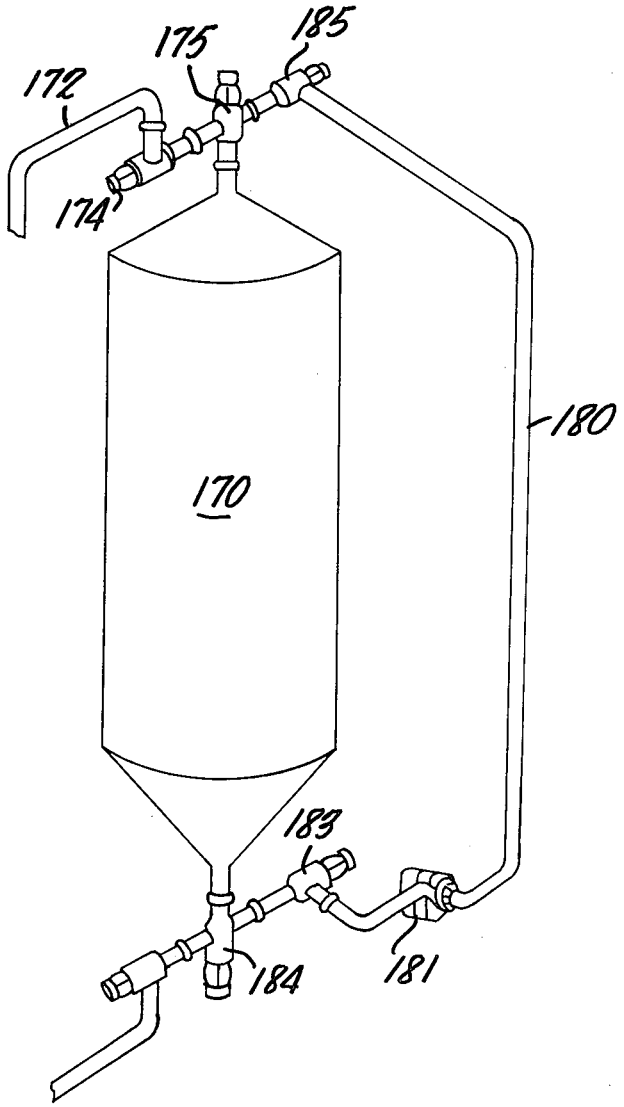
FIG. 12 is a perspective view of a storage tank, according to the invention, for homogenizing the semi-raw food material stored in the tank.

Although the dispersion devices described function to homogenize the liquid or fluid food product upon entering the storage tank long storage results in loss of homogenity. In order to maintain this homogeneity recirculation of the stored food product is accomplished according to the invention. A storage tank 170 according to the invention is illustrated in FIG. 12. It is provided with a food product supply line 172 and aseptic valves 174, 175. The tank is provided with a dispersion device. The stored food product is recirculated through a recirculation line 180 connected to a recirculation pump 181 taking a suction from the bottom of the tank through aseptic valves 183,184. The recirculation line discharges the recirculated food product into the top of the tank through an aseptic valve 185. The recirculation of the food product allows it to be again homogenized by the dispersion device, not shown, in the tank.

Figure 13:
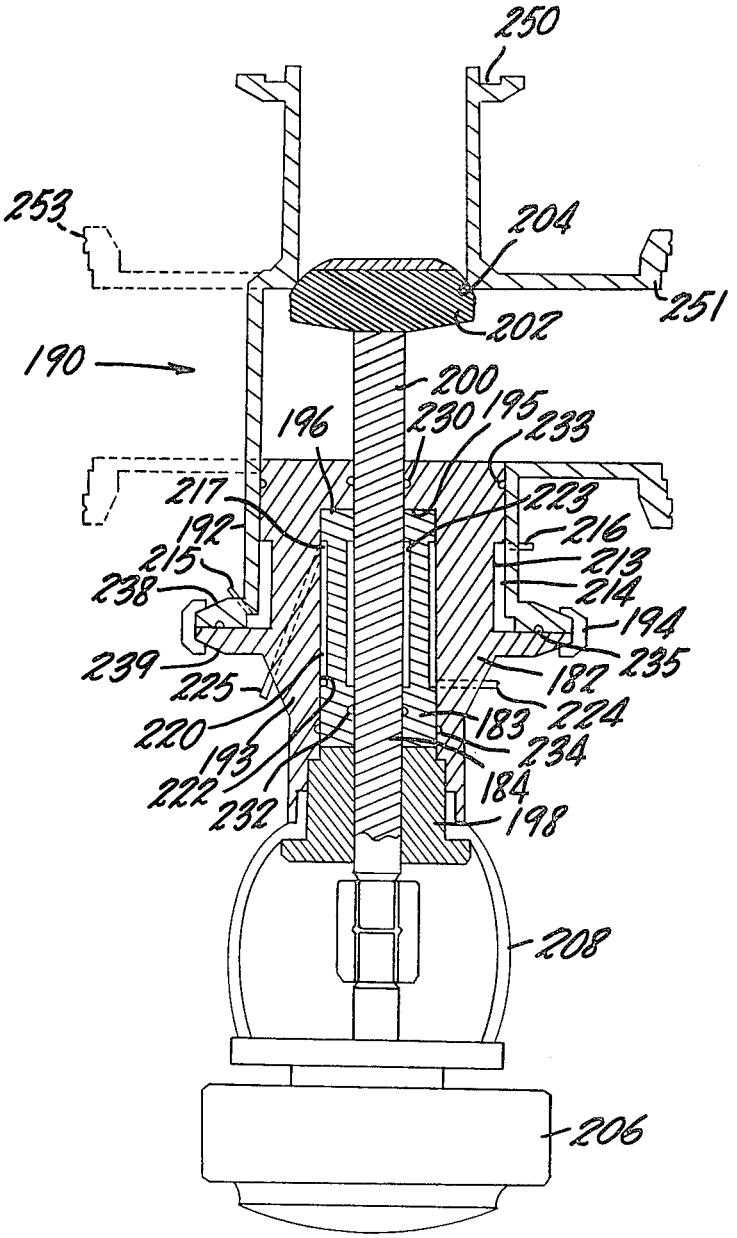
FIG. 13 is a detailed side view, partly in section, of a germ-free valve device used in a system embodying the present invention.

An aseptic valve construction embodied in the present invention is illustrated in FIG. 13. A valve 190 comprises a valve body 192 removably connected to a bonnet 193 by a connector 194. The valve bonnet is provided with an axial recess 195 within which is snugly housed a bushing 196. The bushing is kept in place by a plug or cap 198. A valve stem 200 extends axially through the cap, bushing and bonnet and is fixed to a valve element or disc 202 which seats on a seat 204 for closing and opening the valve by a manual actuator 206 connected to the valve stem and mounted on a bracket 208 clamped between the bonnet and plug or cap 198.

Provision is made in the aseptic valve to sterilize the valve with a sterilizing liquid replenished and renovated or renewed to maintain sterile conditions. Thus the bonnet is provided with a circumferential recess 213 that forms a first chamber 214 jointly with the valve body when the bonnet is mounted on the valve body. A sterilizing liquid is provided onto the chamber, 214 from a source not shown, through an inlet 215 through the valve body and is discharged through an outlet 216 through the valve body.

The bushing 196 is provided with a circumferential recess 217 extending axially between the opposite ends thereof which defines a second chamber 220 jointly with surfaces of the bushing defining the axial recess 195. The bushing has an axial bore 222 having an axial length with a major diameter. The axial length of the bore portion with the major diameter corresponds to the axial length of the circumferential recess. The valve stem and the portion of the axial bore of the bushing having a major diameter jointly define a third chamber 223. A passageway, not shown in the bushing provides communication between the second and third chambers. A sterilizing liquid is provided in the first and second chambers through a passage inlet 224 through the bonnet and is discharged through passage outlet 225 through the bonnet. The sterilizing liquid can be renewed as desired.

In order to maintain a tight seal a plurality of O-rings are disposed between the valve parts to maintain the sterilized integrity of the valve. An O-ring seal 230 is provided between the valve stem and the bushing and it and a second O-ring seal 232 seal the shaft length bathed by sterilizing liquid in the second chamber. An O-ring seal 233 in conjunction with the first seal 230 seals the bushing and the bonnet. Two O-ring seals 234, 235 effectively seal the bonnet and bushing and the latter seal 235 effects a seal at the joint of two flanges 238,239 on the valve body and bonnet respectively about which the connector 194 is circumferentially disposed.

The aseptic valve construction allows for easily disassemblying the valve for cleaning the parts thereof. The valve stem is sealed and the sterilizing liquid in the chamber precludes bateria or microorganisms entering into the processed food products along the valve stem and other elements. This minimizes contamination of the stored food products in a system employing aseptic valves according to the invention.

The aseptic valve body and bonnet are provided with flanges 238,239 for connection to each other. The valve body has flanges 250,251 for effecting connection to other components in a processed food storage system as previously explained. Moreover, aseptic valves according to the invention can be made as valves for different flow of directions as shown by broken lines at 253.

What we claim is:

1. An aseptic storage tank for germ-free storage of partially processed food products comprising, an upright tank having a conical top portion defining an inlet into said top portion for introducing a fluid semi-processed food product into the tank, the conical top portion including an upper inlet apex, a removable manhole plate mounted below said apex, and connecting means connecting said manhole plate to said upper inlet apex, the inner surfaces of said conical top being smooth and flush, an inspection plate defining a closed peephole on said conical top portion, inner surfaces of said inspection plate being smooth and free of recesses, said inlet apex constituting a sole opening for introducing the fluid food product and cleaning fluids into the interior of said conical top portion and into the interior of said tank, a dispersion device disposed suspended in fixed position below and spaced downwardly from the inlet opening interiorly of said tank within said conical top portion for dispersing and homogenizing a fluid while it is being introduced as a flow into the tank through the inlet opening, said dispersion device comprising suspended disc means disposed under the inlet opening with a periphery thereof spaced inwardly from interior wall surfaces of said conical top portion and having upper surfaces spaced downwardly from said inlet and shaped to receive the flow of fluid and splash and direct it upwardly toward the top of the conical top portion and outwardly onto the inner surfaces of the conical top portion, and said device comprising means suspending said disc.

2. A storage container for germ-free storage of partially processed food products according to claim 1, in which said disc is dished upwardly toward said inlet and has an opening therein.

3. A storage container for germ-free storage of partially processed food products according to claim 1, in which said dispersion device comprises a lower, larger disc having a central opening aligned with said inlet and an upper smaller disc having a central opening spaced upwardly from said lower disc and coaxial therewith.

4. A storage container for germ-free storage of partially processed food products according to claim 1, in which said means defining said inlet comprises two coaxial conduit means within said sole opening for introduction of two different flows through said inlet and a second inlet coaxial therewith defined by said two coaxial conduit means.

5. An aseptic storage tank for germ-free storage of partially processed food products according to claim 1, in which said tank has a bottom portion with a single outlet opening, and including a recirculating system for selectively recirculating the stored food product by withdrawing it through the outlet opening and reintroducing it into said tank through the sole inlet opening and onto said dispersion device for dispersion thereof by said dispersion device.

6. An aseptic storage tank for germ-free storage of partially processed food products according to claim 1, in which said tank has a conical bottom portion with a sole outlet opening at an apex of said conical bottom portion.

7. An aseptic storage tank for germ-free storage of partially processed food products according to claim 6, including a recirculatory system for selectively recirculating the stored food product by withdrawing it through said outlet opening and reintroducing it into said tank through the sole inlet opening and onto said dispersion device for dispersion thereof by said dispersion device.

* * * * *